US008485835B2

(12) United States Patent
Liang et al.

(10) Patent No.: US 8,485,835 B2
(45) Date of Patent: Jul. 16, 2013

(54) ELECTRIFIED SUSPENDED CEILING GRID

(75) Inventors: Ying (Lora) Liang, Vernon Hills, IL (US); Daniel Boss, Lake Villa, IL (US); Paul D. LaLonde, Avon, OH (US); Peder Gulbrandsen, Aurora, IL (US)

(73) Assignee: USG Interiors, LLC, Chicago, IL (US)

( * ) Notice: Subject to any disclaimer, the term of this patent is extended or adjusted under 35 U.S.C. 154(b) by 437 days.

(21) Appl. No.: 12/582,926

(22) Filed: Oct. 21, 2009

(65) Prior Publication Data

US 2010/0130055 A1 May 27, 2010

Related U.S. Application Data

(60) Provisional application No. 61/118,067, filed on Nov. 26, 2008.

(51) Int. Cl.
*H01R 25/00* (2006.01)

(52) U.S. Cl.
USPC ..... 439/110; 52/220.6; 439/532

(58) Field of Classification Search
USPC ..... 439/532, 110, 115, 119, 120, 121, 439/209, 210; 52/206.2, 506.07
See application file for complete search history.

(56) References Cited

U.S. PATENT DOCUMENTS

| | | | |
|---|---|---|---|
| 3,146,956 | A | 9/1964 | Schwartz et al. |
| 3,559,146 | A | 1/1971 | Vantonen |
| 3,590,135 | A | 6/1971 | Herbenar et al. |
| 3,649,741 | A | 3/1972 | Fremont |
| 3,683,101 | A | 8/1972 | Liberman |
| 3,710,530 | A | 1/1973 | Valtonen |
| 3,725,568 | A | 4/1973 | Stanley |
| 3,781,567 | A | 12/1973 | Papsco |
| 3,898,782 | A | 8/1975 | Donato |
| 3,918,224 | A | 11/1975 | Sundequist |
| 3,919,457 | A | 11/1975 | Steiner |
| 4,414,617 | A | 11/1983 | Galindo |
| 4,420,798 | A | 12/1983 | Herst et al. |
| 4,540,847 | A | 9/1985 | Gardner |
| 4,631,648 | A | 12/1986 | Nilssen |
| 5,342,204 | A | 8/1994 | Och |
| 5,390,461 | A | 2/1995 | Dwyer |
| 5,803,755 | A | 9/1998 | Kuchar et al. |
| 5,868,489 | A | 2/1999 | Fuller et al. |
| 6,033,097 | A | 3/2000 | Harwood |
| 6,527,406 | B1 | 3/2003 | Slesinger et al. |
| 6,540,372 | B2 | 4/2003 | Joseph |

(Continued)

FOREIGN PATENT DOCUMENTS

| | | | |
|---|---|---|---|
| JP | 2004036138 | A | 2/2004 |

OTHER PUBLICATIONS

International Search Report, PCT/US2009/061607, dated May 24, 2010.

*Primary Examiner* — Felix O Figueroa
(74) *Attorney, Agent, or Firm* — Pearne & Gordon LLP

(57) ABSTRACT

A suspended ceiling grid tee of conventional cross-sectional shape having a plurality of generally planar parallel and orthogonal surfaces and at least two electrically isolated conductor strips attached to the planar areas of the tee surfaces extending along substantially the full length of the tee, a connector for supplying low voltage electrical power to or from the conductors, the connector having a configuration complementary to the cross-sectional shape of the grid tee and including at least two electrical contacts for energizing each of said conductor strips when said connector is positioned on said grid tee.

4 Claims, 8 Drawing Sheets

U.S. PATENT DOCUMENTS

| | | | | |
|---|---|---|---|---|
| 6,722,918 | B2 | 4/2004 | McCoy | |
| 7,351,075 | B1 | 4/2008 | Patterson et al. | |
| 2002/0109984 | A1 | 8/2002 | Bischel et al. | |
| 2003/0021116 | A1 | 1/2003 | Miller et al. | |
| 2003/0172609 | A1 * | 9/2003 | Rebman | 52/506.07 |
| 2007/0103824 | A1 | 5/2007 | Patterson et al. | |
| 2008/0087464 | A1 * | 4/2008 | Patterson et al. | 174/70 C |
| 2008/0090431 | A1 | 4/2008 | Patterson et al. | |
| 2008/0090432 | A1 | 4/2008 | Patterson et al. | |
| 2008/0155915 | A1 | 7/2008 | Howe et al. | |
| 2008/0197702 | A1 | 8/2008 | Banach | |

* cited by examiner

ELECTRIFIED SUSPENDED CEILING GRID

This application claims the priority of U.S. Provisional Application No. 61/118,067, filed Nov. 26, 2008.

BACKGROUND OF THE INVENTION

The invention relates to suspended ceiling structures and, in particular, to electrification of such ceiling structures.

PRIOR ART

Commercial building spaces such as offices, laboratories, light manufacturing facilities, health facilities, meeting and banquet hall facilities, educational facilities, common areas in hotels, apartments, retirement homes, retail stores, restaurants and the like are commonly constructed with suspended ceilings. These suspended ceiling installations are ubiquitous, owing to their many recognized benefits. Such ceilings ordinarily comprise a rectangular open grid suspended by wire from a superstructure and tile or panels carried by the grid and enclosing the open spaces between the grid elements. The most common form of grid elements has an inverted T-shaped cross-section. The T-shape often includes a hollow bulb at the top of the inverted stem of the T-shape. A popular variant of this standard T-shape includes a downwardly open C-shaped channel formed by the lower part of the inverted tee.

Advances in electronics has fed further advances and lead the world into the digital age. This digital movement creates an ever-increasing demand for low voltage direct current (DC) electrical power. This demand would seem to be at least as great in finished commercial space as any other occupied environment. A conventional suspended ceiling has potential to be an ideal structure for distributing low voltage electrical power in finished spaced. Many relatively low power devices are now supported on such ceilings and newer electronic devices and appliances are continuously being developed and adopted for mounting on ceilings.

The ceiling structure, of course, typically overlies the entire floor space of an occupiable area. This allows the ceiling to support electronic devices where they are needed in the occupied space. Buildings are becoming more intelligent in energy management of space conditioning, lighting, noise control, security, and other applications. The appliances that provide these features including sensors, actuators, transducers, speakers, cameras, recorders, in general, all utilize low voltage DC power.

As the use of electronics grows, the consumption of low voltage electrical power likewise grows. This seemingly ever accelerating appetite for DC power presents opportunities for more efficient transformation of relatively high voltage utility power typically found at 110/115 or 220/240 alternating current (AC) volts with which the typical enclosed space is provided. Individual power supplies located at the site of or integrated in an electronic device, the most frequent arrangements today, are often quite inefficient in transforming the relatively high voltage AC utility power to a lower DC voltage required by an electronic device. Typically, they can consume appreciable electric power in a standby mode when the associated electronic device is shut off. It is envisioned that a single DC power source serving the electronic needs of a building or a single floor of a building can be designed to be inherently more efficient since its cost is distributed over all of the devices it serves and because it can take advantage of load averaging strategies.

SUMMARY OF THE INVENTION

The invention has application in the unique conditions that an electrified low voltage suspended ceiling grid affords. The rigid structure of the grid elements allows them to readily support the electrical conductors and, in some instances, form the conductors themselves without presenting a shock hazard, thereby eliminating the need for conduit, raceways, or other separate support structures or shields. Further, the typical grid tee has a plurality of planar faces that readily accommodate the presence of separate conductor strips, each isolated from the other and exposed or capable of easily being exposed to effectuate a connection for receiving or supplying power. Multiple circuits on a grid enable the use of multiple voltages and simplified signal transmission.

The invention utilizes the multiplanar face character of conventional grid tees to provide connectors to reliably join corresponding conductors of one grid to another and make connections for supplying power to and for tapping power from the grid. The low voltage conductors carried by the grid tees can be conductive ink, foil, tape, and/or wire suitably electrically insulated from the grid. The connectors can be arranged to join conductors of grids aligned end-to-end or at right angles to one another.

In some embodiments of the invention, the cross tees are electrically isolated from the main tees allowing the main tees to act as the exclusive conductors. In such arrangements, the inherent conductivity of a steel or aluminum grid tee is used to conduct electrical power through the ceiling grid.

In a typical electrified suspended ceiling grid, three types of connections will typically be required. These connectors will provide power to the grid, connection between tees, and connection to devices operated by the electrical energy delivered through the grid.

DESCRIPTION OF THE PREFERRED EMBODIMENT

It will be understood that the following disclosure relates to the electrification of suspended ceiling grid tees of generally conventional configuration or cross-section and that normally the electrification will be limited to low voltage DC systems, generally between 3 and 24 volts DC.

Figure 1:
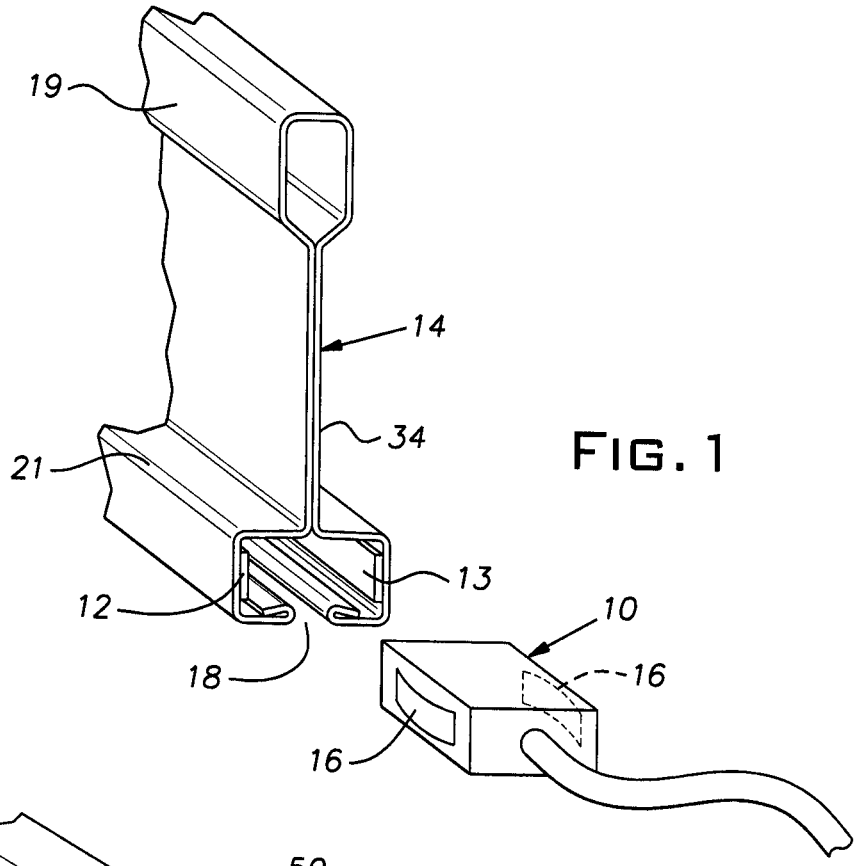
FIG. 1 is a schematic fragmentary isometric view showing a connector used with an open slot-type grid tee.

Referring now to FIG. 1, there is shown a connector 11 useful for electrically connecting a device to conductors 12, 13 carried on a generally conventional open slot grid tee 14. The device can be an AC to DC converter, typically converting 60 cycle 110-230 volts AC to 3 to 24 volts DC as desired. The electrical conductors 12, 13, typically, will be conductive strips of ink containing metal or carbon, metal foil, or metal tape. In other arrangements, the conductors 12, 13 can be metal wire such as copper or aluminum. In all instances, except where the grid tee 14 is an electrical insulator itself, the conductors will be electrically isolated from the grid tee by a suitable layer of electrical insulation which may be applied on the grid tee before or when the conductors are applied to the grid tee or applied to the conductors before the latter are affixed to the tees. The conductors 12, 13 can be a conductive coating of ink or like substance that is applied before or after the grid tee is roll-formed from sheet metal. Typically, the grid tee will be formed of light gauge steel or aluminum and will be provided with a protective coating which can serve as an electric insulator. Where the conductors 12, 13 are foils or tape of a suitable metal such as copper or aluminum, they will be adhesively bonded to the grid tee over whatever protective layer is applied to the metal tee stock and any supplemental insulator. The foil or tape conductors, like the conductive ink, can be applied to the grid tee before or after it is roll-formed into its finished shape. A wire conductor, whether it is round or flat, can be adhesively bonded to the grid tee and typically will be attached after the grid tee is formed. Where a conductor 12, 13 is to receive a connector, such as the connector 10, the overlying insulating material, if any, is removed. At the ends of the grid tees, for example, the overlying or overcoated insulation on the conductors 12, 13 can be initially omitted or removed at the time of manufacture of the grid tee. In the arrangement of FIG. 1, the connector 10 can have contacts 16 of brass, or the like, which are inherently spring-like or have a spring assist to make a mechanical, electrical contact with the surface of the respective conductors 12, 13. The horizontal spacing of the contacts 16 in a free state is greater than the horizontal space between the conductors 12, 13. Electrical leads 17 from the contacts 16 can exit the connector 10 either horizontally as shown or vertically through a downwardly open slot 18 of the tee 14.

Figure 2:
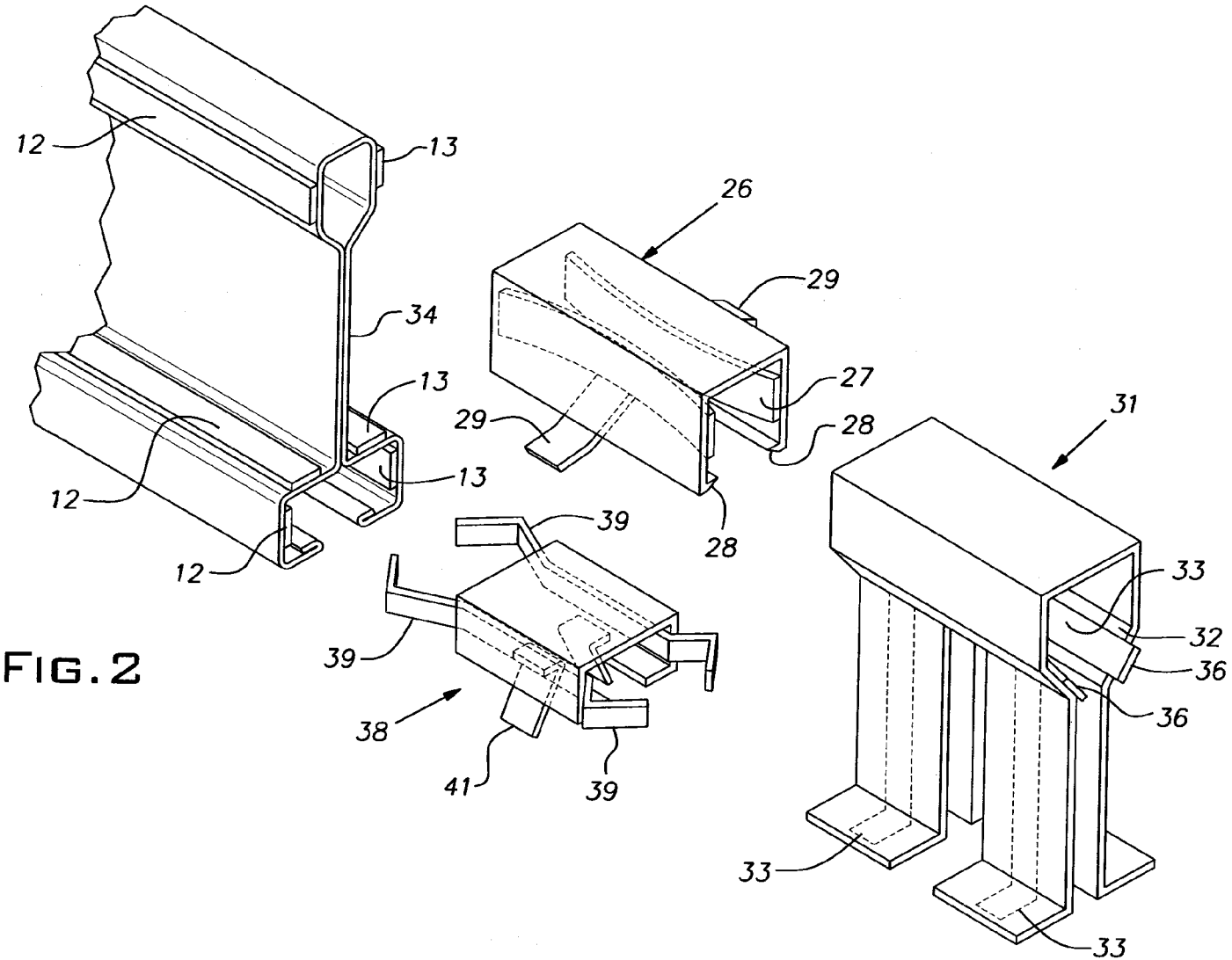
FIG. 2 is a fragmentary perspective view of the downwardly open channel style grid tee and a connector for bridging a joint with an identical grid tee.

FIG. 2 is a fragmentary perspective view of the downwardly open channel style grid tee 14 having three separate pairs of conductors 12, 13. An upper pair of conductors 12, 13 are on opposite vertical sides of a hollow reinforcing bulb 19, another pair of conductors 12, 13 are on opposite upper sides of the channel flange 21 and a third pair of conductors 12, 13 are on internal vertical surfaces of the channel flange. A connector 26 having the general form of a U-shaped channel is formed of a suitable electrically insulating medium such as PVC and includes, on its interior vertically opposed sides, a pair of elongated electrically conducting strips 27 of brass or other suitable material. The connector 26 is proportioned to snap onto the bulb 19 and be retained thereon frictionally with the assistance of small catches 28 proportioned to grip the undersides of the bulb. The conducting strips or blades 27 are arranged to make electrical contact with the conductors 12 or 13 of a pair of grid tees in end-to-end relation. In this manner, the connector 26 electrically joins the conductors 12, 13 associated with the bulbs 19. Another connector 31, is again molded of a suitable electrical insulator such as PVC. The connector 31 is a U-shaped body proportioned to fit over the connector 26 and be snapped onto the bulb 19 and retained thereon by extensions 32 that underlie the bulb 19. On the interior of each of its legs, the connector has jumper electrical conductors 33 typically made of brass or other spring-like material. The jumper conductors 33 press against the respective conductors 12, 13 on opposite sides of a web 34 of the grid tee 14. The conducting strips 27 of the connector 26 have laterally extending terminals 29 that can be used to feed or supply power to the underlying conductors 12, 13. These terminals are optional and if provided, can be broken off when the connector 26 is installed where they are unnecessary. The jumper conductors 33 can have terminals 36 extending from the body of the connector 31 for supplying or feeding power to or from the associated grid tee conductors 12, 13. A connector 38 is an electrically insulating rectangular body having opposed spring-like metallic blades 39 of copper or brass, for example. The blades 39 are insert molded in the connector or otherwise retained thereon. The connector 38 and blades 39 are proportioned so that the blades 39 form electrical jumpers for the conductors 12, 13 when the connector is inserted in the channel flanges 21 of a pair of abutting ends of end joined grid tees 14. Terminals 41 can be provided on each of the blades 39 to enable power to be supplied or drawn from the connectors 12, 13.

Figure 3:
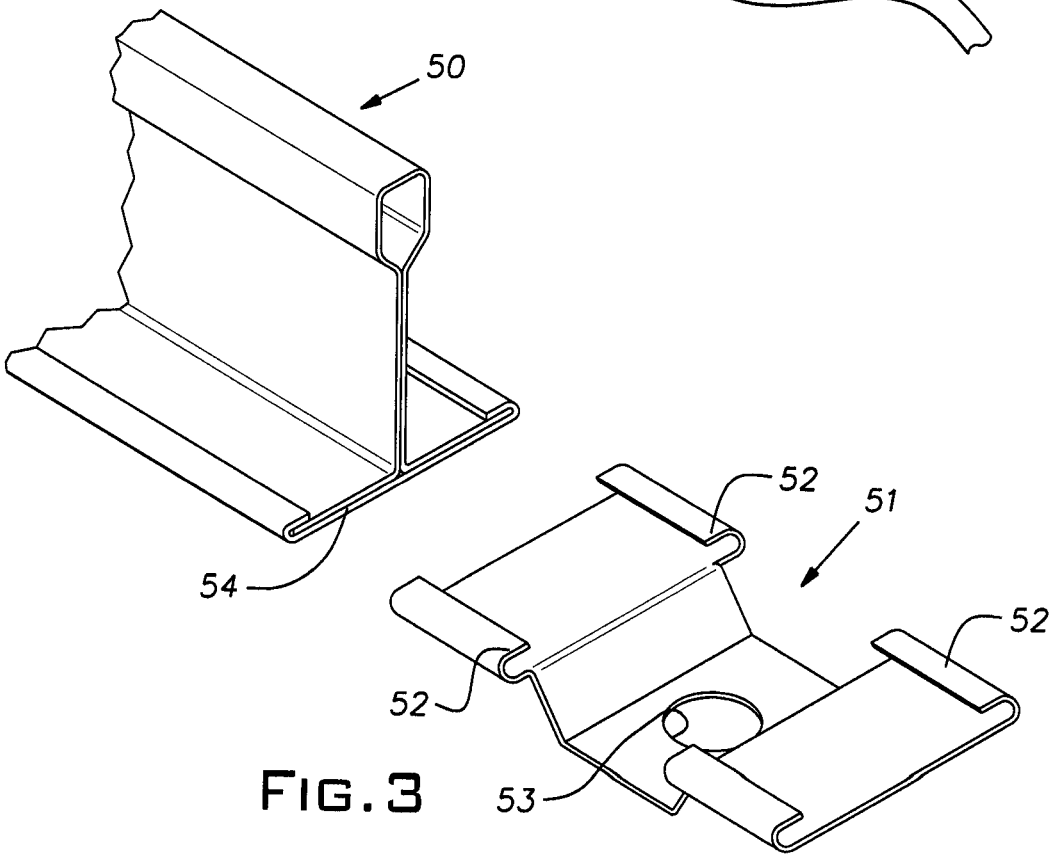
FIG. 3 is an isometric view of a clip that can be used to affix an electronic device to a grid tee of conventional cross-sectional shape.

With reference to FIG. 3, a metal or plastic clip 51 can be snapped from below onto the opposite edges of the flange of a grid tee 50. The clip 51 has grips 52 that will engage the upper sides of the grid tee flange 54. A central portion of the clip 51 lies below the plane of the grip and has an aperture 53 enabling an electronic device or fixture to be attached to it with an appropriate fastener extending through the aperture.

Figure 4:
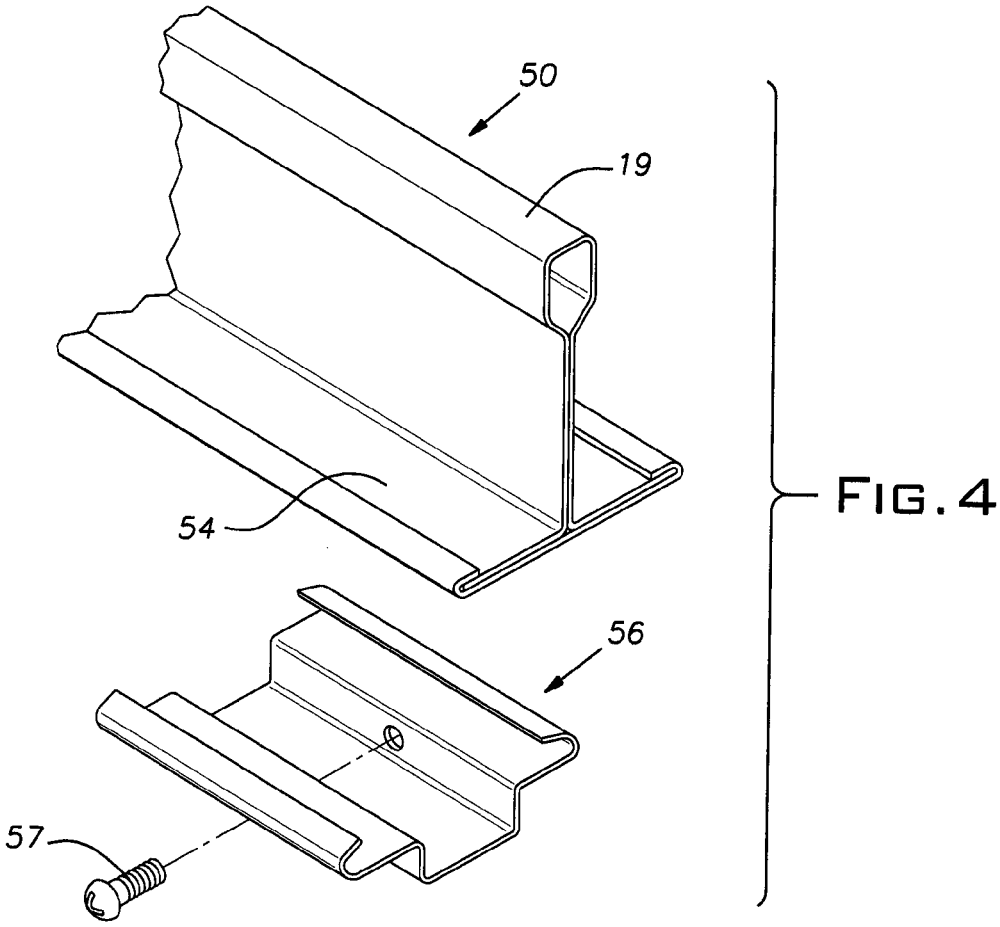
FIG. 4 is an isometric view of an alternative suspension clip.

In FIG. 4 there is shown an alternative suspension clip 56 arranged to grip the flange 54 of a conventional grid tee 50. The clip 56 can be captured on the grid tee flange 54 by tightening a screw 57 thereby drawing opposite in turned edges together to capture the grid tee flange therebetween. It will be understood that appliances can be suspended from the grid tee 14 shown in FIGS. 1, 2, 9A, 9B, 10 and 11 by inserting a suitably formed element within the open channel of the tee. This element may be T-shaped and rotated 90 degrees to lock into the channel. In a manner like that of track lighting systems, the inserted T-shaped lock can have contacts on opposite sides which make electrical contact with conductors 12, 13 such as that shown in FIGS. 1, 2, 9A, and 9B in the interior walls of the downwardly open channel.

It will be understood that the various connectors disclosed herein, while shown for connecting grid tees abutted end-to-end in a straight line, can be configured to provide jumper circuits for grid tees that intersect at a right angle.

Figure 5:
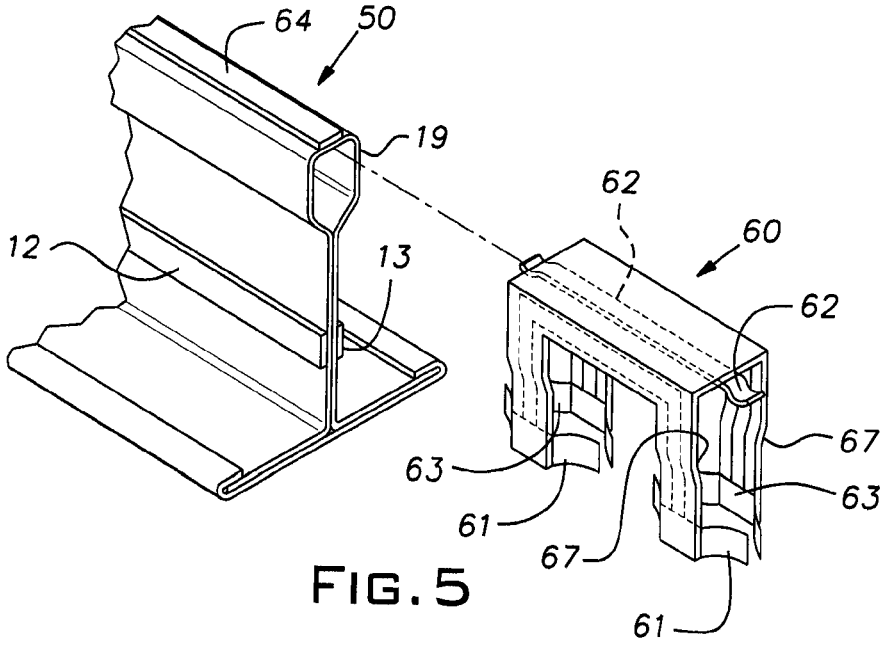
FIG. 5 is an isometric view of a connector having three separate conducting jumpers.

FIG. 5 shows a bridging connector 60 molded or otherwise formed of an electrically insulating material such as PVC and on which are three separate electrically conducting paths 61, 62 and 63. Each of the paths 61-63 can be formed of metal stock such as copper or brass, preferably having spring-like characteristics so as to establish mechanical contact with conductors 12, 13 and 64. Depending legs 66 of the connector can be proportioned to hold the conductors 61-63 in contact with the respective conductors 12, 13 and 64. The connector 60 is releasably held in place by integral hooks 67 which catch the underside of the bulb 19. The connectors 26, 31, 38 of FIGS. 2 and 60 of FIG. 5 can be used to bridge between the conductors 12, 13, 64 of main tees joined together end-to-end with conventional tee connectors.

Figure 6:
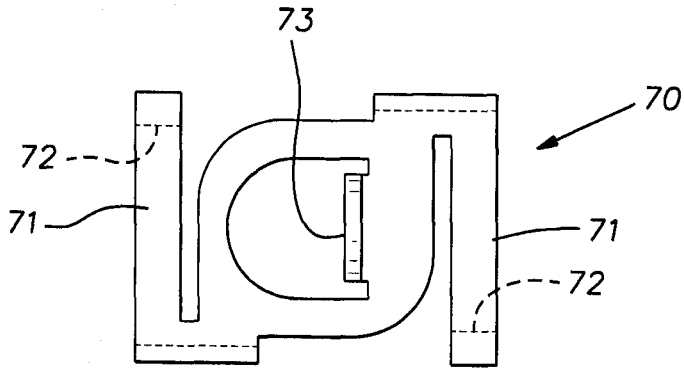
FIG. 6 is a bottom view of a bracket for attaching electrical devices to a grid.
Figure 6A:
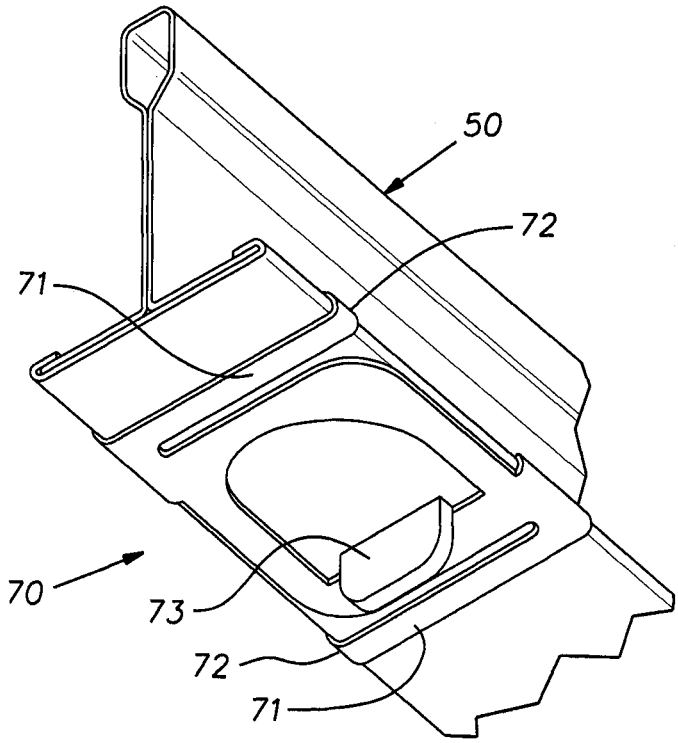
FIG. 6A is an isometric view of the bracket of FIG. 6 installed on a grid tee.

Referring to FIG. 6, a metal bracket 70 is shown for suspending a device which can be powered or which otherwise can be connected to the conductors 12, 13 provided on a grid tee 50. The bracket includes a pair of arms 71 with reverse turned ends 72. The bracket 70 can be twisted onto the flange of a grid tee 50. A central tab is bent downwardly out of the plane of the main body of the bracket and affords an anchor point for a device to be suspended on the ceiling.

Figure 7:
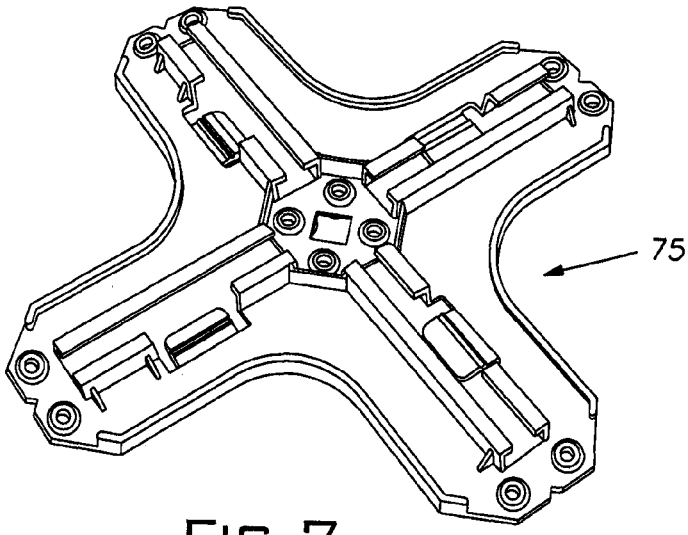
FIG. 7 is an illustration of a cruciform plastic injection molded bracket to be used at intersecting grid tees to suspend an electrical or electronic device from the grid.
Figure 7A:
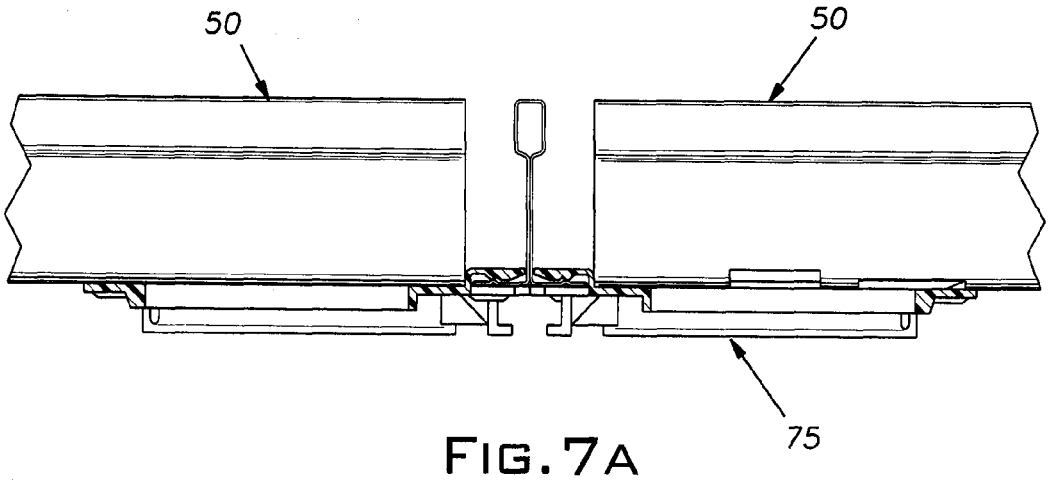
FIG. 7A is a cross-sectional elevational view of the bracket of FIG. 7 installed on an intersection of grid tees.

FIG. 7 illustrates an injection molded plastic bracket 75 which can be clipped onto the four flange areas of intersecting grid tees. The bracket 75 is disclosed in U.S. patent application Ser. No. 11/098,626, filed Apr. 4, 2005.

The brackets 70, 75 can be provided with suitable electrical conductors such as formed by copper or brass sheet stock capable of contacting conductors 12, 13 disposed on upper outer edges of the grid tee flange on which they are mounted. The bracket conductors are arranged to bring electrical current to devices suspended by their respective brackets 70, 75. It will be understood that various other types of brackets can be provided to suspend a device from a grid tee and at the same time make contact with the conductors 12, 13 by physical contact with these conductors. Brackets can, in addition to being snapped on and twisted on as disclosed above, can also, for example, be taped on, hooked on, or magnetically retained.

Figure 8:
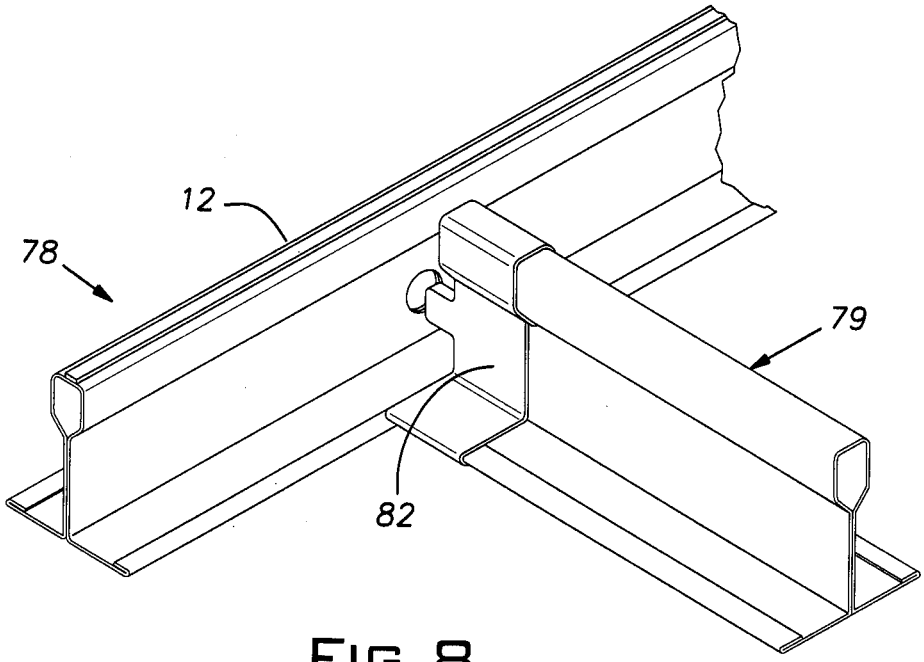
FIG. 8 is a fragmentary isometric view of the intersection of a cross tee carrying a novel insulating connector with a main tee.

Regarding FIG. 8, a main tee 78 of conventional inverted tee cross section is intersected by cross tees 79 of like cross section. While only one cross tee 79 is shown, it will be understood that, as is conventional, a plurality of cross tees will intersect the main tee 78 at a regular spacing and, normally, from opposite sides. The main tee 78 optionally carries a conductor 12. Alternatively, the conductor 12 as well as other conductors paired with this conductor 12 or with each other may be omitted and the main tee 78 itself can be electrified. At least one end of the cross tee 79 is electrically insulated from the tees supporting it. In the illustrated example of FIG. 8, this electrical isolation is accomplished by an electrically insulating connector 81 which, for example, can be molded of a suitable thermoplastic or thermosetting plastic material. The connector 81 is configured to slip over the respective end of a cross tee 79. The connector 81 includes a tab 82 that fits through a slot in the main tee 78 and which preferably couples with a connector of a cross tee on the opposite side of the main tee 78. As an alternative of the insulating connector 81 shown in FIG. 8, the entire cross tee can be made of a non-electrically conductive material, such as a suitable thermoplastic. Where desired, the full thermoplastic cross tee can be extruded and the lower face of its flange can be capped with a sheet metal facer as long as provisions are taken to avoid contact of such facer with the main tee where the main tee is electrified. With lines of parallel main tees electrically isolated from one another, by the arrangements described here in connection with FIG. 8, alternate lines of main tees can be held at one polarity and intervening lines can be held at the opposite polarity. An electrically operated device supported on the ceiling grid can be powered by connecting one of its electrical leads to one line of main tees and its other electrical lead to an adjacent line of main tees.

Figure 9A:
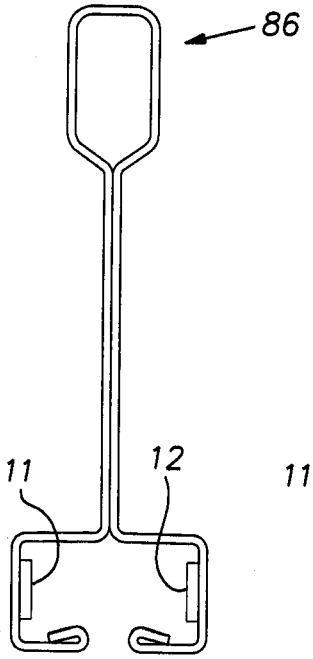
FIG. 9A is a cross-section of a cross tee having an arrangement for two conductors at opposite polarities.
Figure 9B:
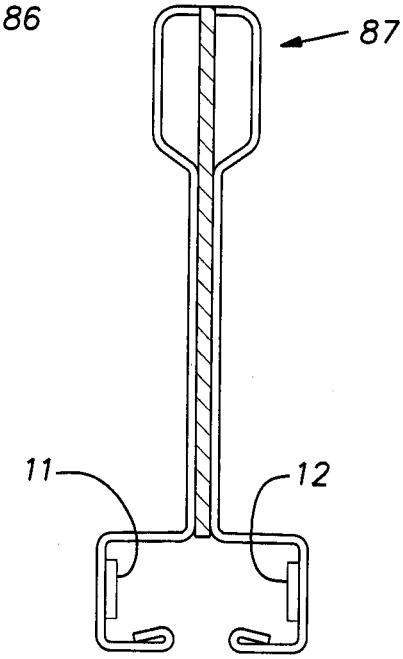
FIG. 9B is a cross-section of a modified form of cross tee having provision for two conductors at opposite polarities.

FIGS. 9A and 9B illustrate cross tees 86, 87 of alternative constructions that each provide two conductive paths, one on each side of a vertical mid-plane of the cross-section. The cross tee 86 has conductors 12, 13 situated on the interior vertical sides of its flange channel. Similarly, the cross tee 87 has conductors 12, 13 on the vertical interior sides of the lower flange channel. The cross tee 87 is vertically bisected by an insulating sheet 88. Keeping in mind that the conductors 12, 13 are electrically isolated from the typically metal bodies of the cross tees 86 and 87, and that the bodies of the tees themselves can serve as one conductor, one of the conductors 12 or 13 can be eliminated in the case of the cross tee 86 in FIG. 9A and both of the conductors 12, 13 can be eliminated in the case of the cross tee 87 of FIG. 9B. In both of the latter arrangements, two separate conductive paths will remain. The cross tees 86, or 87 can be used in suspended grids in which alternate main tees are electrified with one polarity and intervening main tees are electrified with the opposite polarity. Suitable connections can be made with either of the cross tees 86 or 87. The left side of the tee 86 or 87 is at one polarity being fed from one end and the right side is at the opposite polarity being fed from the next adjacent main tee. It will be understood that end surfaces of the body of the cross tees 86, 87 are appropriately insulated to prevent inadvertent shorting of these cross tee bodies with the main tee.

Figure 11:
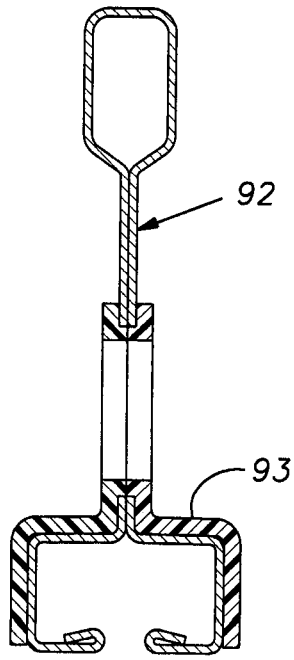
FIG. 11 is a cross-sectional view of the main tee and insulator of FIG. 10.
Figure 10:
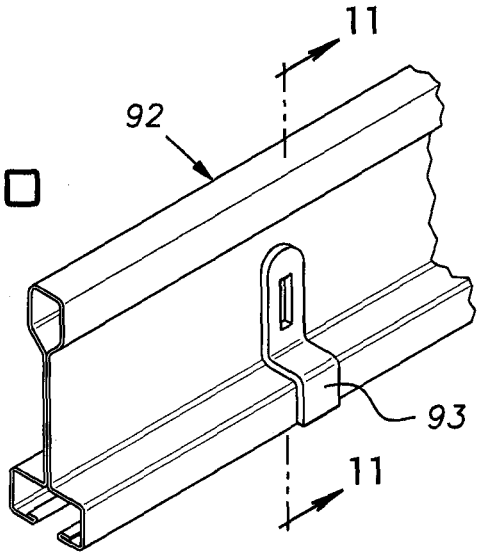
FIG. 10 is a fragmentary isometric view of a main tee having an electrical insulator forming the cross tee receiving slot area.

FIGS. 10 and 11 illustrate a manner of isolating cross tees from main tees 92. Where a main tee conventionally has a slot for receiving the end connectors of cross tees, an insulator plug 93 is assembled or otherwise created in this area to prevent the metal of the cross tees including their connectors from shorting with the main tee. The plug insulator 93 can be a molded plastic insert that prevents any physical contact of the cross tee directly with the metal body of the main tee 92. While the main tee 92 is illustrated as being of the downwardly open channel style, this technique of isolating the cross tee receiving slot area electrically from the cross tees can be used in the more common flat lower flange style grid tee such as shown in FIG. 3. Where the main tees are electrified, they can be supplied with power from the wall channel by either direct contact or with electrical jumpers.

The foregoing disclosed electrified tees can be arranged in numerous patterns in a given room or space. Perhaps the simplest arrangement is to electrify all of the main tees by applying voltage to all of the conductors 12, 13 on these main tees or, as described, optionally to the main tees themselves.

Figure 12:
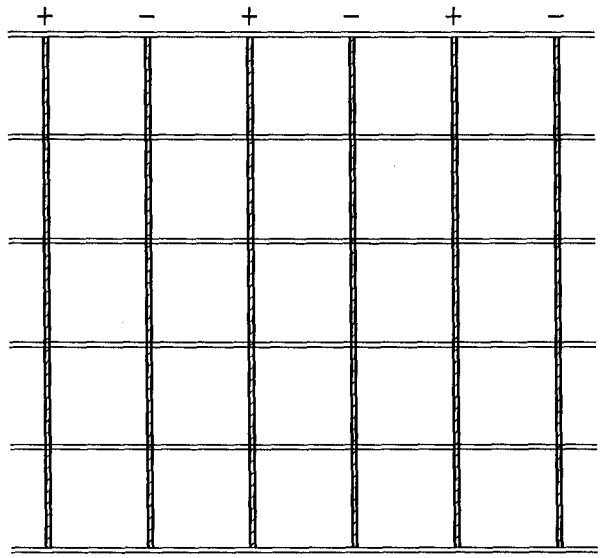
FIG. 12 is a diagrammatic illustration of a grid system in which all of the tees running in a common direction are electrified.
Figure 13:
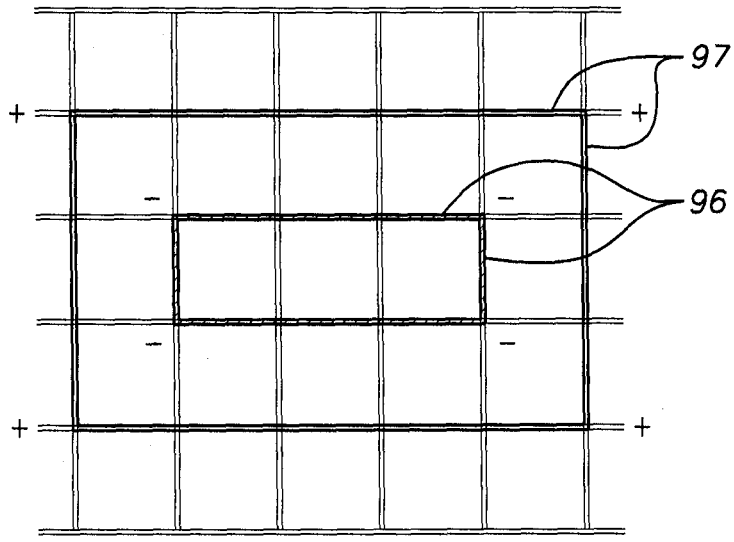
FIG. 13 illustrates a grid system in which the grid tees are electrified in concentric rectangles.
Figure 14:
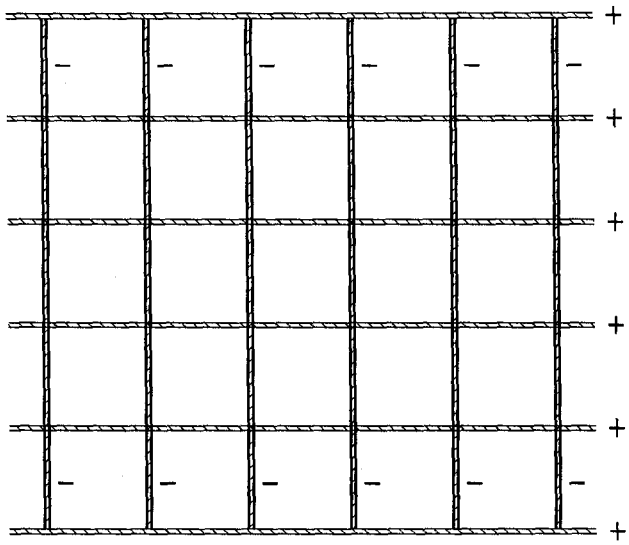
FIG. 14 is a schematic view of a grid system in which grid tees running in one direction are at one polarity and tees running in the perpendicular direction are at the opposite polarity.
Figure 15:
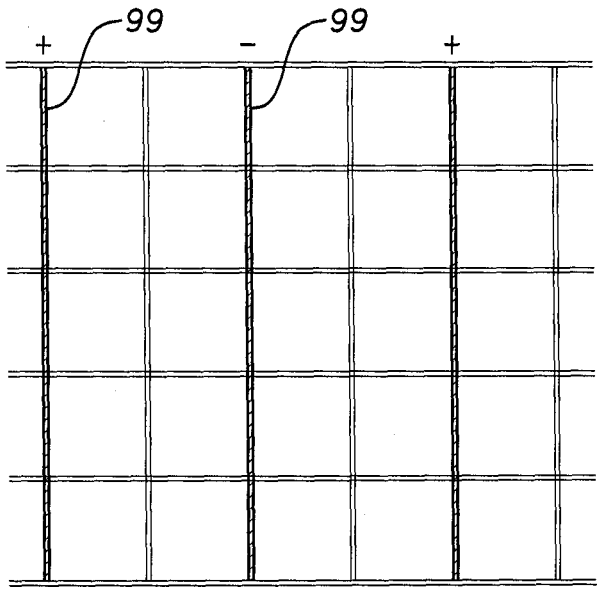
FIG. 15 illustrates a grid system in which only the main tees are electrified.

In the grid arrangements of FIGS. 12 and 14-15, it will be understood that the main tees are electrically isolated from the cross tees by a suitable insulation technique such as shown in FIG. 8 or 10 and 11. This will be true of the arrangements of FIG. 13 except that certain cross tees are deliberately electrically connected to the main tees. Moreover, in the arrangements of FIGS. 12-15, it will be understood that the electrification voltages are applied to the bodies of the tees themselves.

Referring to FIG. 12, all of the grid tees 14 or 50 running in a common direction (as shown with hatching) whether they be main tees or cross tees, are electrified and alternate rows are at one polarity and intervening rows are at the opposite polarity.

Referring to FIG. 13, grid tees shown there are electrified in concentric rectangular patterns. For example, a rectangular loop 96 of grid tees (hatched and bold) is electrified at one polarity in a continuous looped circuit. The loop 96 is surrounded by a larger loop 97 which is continuous and is at the opposite polarity from the loop 96.

Referring to FIG. 14, the grid can be electrified such that the tees running in one direction are of one polarity and the tees running in the perpendicular direction can be of the opposite polarity.

Referring to FIG. 15, there is shown a technique of electrifying a grid which consists of electrifying only the main tees. This can potentially result in the simplest system to manufacture and install. Such an arrangement as shown in FIG. 16 can be implemented with each main tee carrying at least two conductor paths, it being understood that one of the conductors can be the body of the grid tee itself. Another way of electrifying the system shown in FIG. 16 is to electrify alternate main tees with one polarity and intervening main tees with the opposite polarity. This arrangement can be simplified where the body of the main tees 99 themselves are electrified and the cross tees are electrically isolated from these main tees. In the arrangement of FIG. 15, devices carried on the ceiling grid can be powered by conductors attached to such devices and connected to the closest two main tees. The arrangements of FIGS. 12-15, can be electrified, for example, from the wall angle. The wall angle can be locally electrically isolated at points where non-electrified grid tees or grid tees of an opposite polarity rest.

There is disclosed an expandable ceiling grid in U.S. patent application Ser. No. 12/140,293, filed Jun. 17, 2008. The various conductor arrangements and electrification patterns disclosed hereinabove can be used or adapted for use in such an expandable system. Where the expandable grid relies on hinge elements formed separately from the grid elements, these hinge elements can be partially or wholly molded of a suitable plastic material that is electrically insulating and thereby lends itself to the presently disclosed electrification methods.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. In combination, a suspended ceiling grid having metal body main tees and cross tees intersecting the main tees, entire metal bodies of the main and cross tees being electrically conductive and being defined by upper reinforcing bulbs, lower flanges and intermediate webs, the bulb, flange and web of each tee being monolithic with each other, the entire metal bodies of the cross tees being electrically insulated from the entire metal bodies of the main tees by electrical insulators interposed between main tees and cross tees wherein either the entire metal bodies of the cross tees and/or adjacent entire metal bodies of the main tees can be are maintained at different electrical potentials.

2. The combination as set forth in claim 1, wherein the cross tees have end connectors that project into longitudinally spaced slots of the main tee, the end connectors being formed of an electrically insulating material and defining said electrical insulators.

3. The combination as set forth in claim 1, wherein the cross tees have end connectors that project into longitudinally spaced slots of the main tee, the slots being formed of electrical insulating material and defining said electrical insulators.

4. The combination as set forth in claim 1, having the grid tees arranged in a rectangular pattern and their bodies carrying voltages at opposite polarities, the tees of each polarity being arranged in an associated regular pattern whereby an electrical device carried on the grid can draw electrical power from the grid by connecting one of its electrical sides to the body of one of the grid tees of one polarity and the other of its electrical sides to the body of one of the grid tees of the other polarity.

* * * * *

UNITED STATES PATENT AND TRADEMARK OFFICE

CERTIFICATE OF CORRECTION

PATENT NO. : 8,485,835 B2
APPLICATION NO. : 12/582926
DATED : July 16, 2013
INVENTOR(S) : Ying Lora Liang et al.

It is certified that error appears in the above-identified patent and that said Letters Patent is hereby corrected as shown below:

In the Claims

Column 8, line 18 (Claim 1, line 11), delete “can be”.

Signed and Sealed this
Third Day of September, 2013

Teresa Stanek Rea
*Acting Director of the United States Patent and Trademark Office*